US005726399A

United States Patent [19]

Murphy

[11] Patent Number: 5,726,399

[45] Date of Patent: Mar. 10, 1998

[54] APPARATUS FOR SCANNING ELEVATOR CALL BUTTONS

[75] Inventor: James L. Murphy, Streamwood, Ill.

[73] Assignee: Inventio AG, Hergiswil, Switzerland

[21] Appl. No.: 597,693

[22] Filed: Feb. 6, 1996

[51] Int. Cl.[6] ..... B66B 1/34

[52] U.S. Cl. ..... 187/395; 181/391; 340/825.82

[58] Field of Search ..... 187/380, 391, 187/393, 395, 247; 340/825.82

[56] References Cited

U.S. PATENT DOCUMENTS

| | | | |
|---|---|---|---|
| 4,022,296 | 5/1977 | Mandel et al. | 187/29 R |
| 4,134,107 | 1/1979 | Miller et al. | 340/381 |
| 4,190,836 | 2/1980 | Kimura et al. | 340/762 |
| 4,230,206 | 10/1980 | Brooks | 187/29 R |
| 4,376,930 | 3/1983 | Sasao | 340/19 R |
| 4,654,657 | 3/1987 | Meyer | 340/825.8 |
| 4,805,739 | 2/1989 | Lind et al. | 197/121 |
| 5,398,783 | 3/1995 | Jacoby | 187/395 |
| 5,454,448 | 10/1995 | Bittar et al. | 187/395 |

FOREIGN PATENT DOCUMENTS 0408765 1/1991 European Pat. Off. .

*Primary Examiner*—Robert Nappi
*Attorney, Agent, or Firm*—William J. Clemens

[57] ABSTRACT

An apparatus for scanning and illuminating elevator car call button switches includes an individual switch and illumination circuit for each floor served by the car and a control circuit connected in a row/column matrix with the individual circuits for scanning for actuated switches and illuminating push buttons associated with registered calls. Each individual circuit has a switch module which responds to scanning signals from the control circuit by generating a switch actuated signal when the call button switch located therein is actuated. The control circuit generates illumination signals to each individual circuit for which a call has been registered to activate LED's and light the associated push button. The control circuit generates the scanning signal, reads the switch actuated signals and generates the illumination signals during separate timed cycles. A pulse stretcher module in the individual circuits responds to the illumination signals to maintain the LED's lighted for a significantly longer time than the duration of the timed cycles. The switch and illumination circuit and the control circuit cooperate to generate and respond to different magnitude switch actuated signals when an access control switch is utilized to lock out selected floors.

17 Claims, 3 Drawing Sheets

DATA IN
51
DATA CLK
57
COL DATA
LOAD
58
52
50
PARALLEL INPUT/ SERIAL OUTPUT SHIFT REGISTER
18
19
V1
80
81
83
84
85
53
11
SHIFT REGISTER
82
75
74
54
RESISTOR ARRAY
SERIAL INPUT/ PARALLEL OUTPUT SHIFT REGISTER
LED OUT
ENABLE
60
LINE COUPLER
V1
RESISTOR ARRAY
55
66
61
64
72
V+
V-
SHIFT REGISTER
R&C OUT
LATCH
59
DATA OUT
56
71
73
61
62
65
63
68
69
70
76
RESISTOR ARRAY

APPARATUS FOR SCANNING ELEVATOR CALL BUTTONS

BACKGROUND OF THE INVENTION

The present invention relates generally to an apparatus for monitoring a plurality of illuminated switches and, in particular, to an apparatus for maintaining the magnitude of illumination of a plurality of elevator call button switches while scanning for actuated switches.

Scanning the contact status of a plurality of switches utilizing a row/column matrix connection has been used for many years in those cases where a large quantity of switches must be interfaced into control circuitry. LED illumination of the buttons of such switches is difficult because scanning signals are active on any given switch for a short period of time. Light output is reduced because the LED must be powered by pulses of current to provide scanning intervals between pulses. To compensate for the drop in light output, the magnitude of the current pulses can be increased. LED's can withstand current pulses three to ten times their maximum continuous current level. In many applications, high current pulses do provide adequate illumination levels of the switch button. However, push buttons with large button areas cannot be adequately illuminated with pulsed LED's.

Many elevator car operating panels having illuminated call push switches also are provided with key switches with maintained contacts for security access control. In a scanned switch matrix application, additional wires must be added to monitor the contact state of these access control switches. This additional wiring adds cost and assembly labor to an elevator installation.

The magnitude of LED illumination is determined by the actual current flowing through the device and indirectly by the voltage applied to the LED driver circuitry. In installations where the voltage applied to the LED and the driver circuitry varies, the illumination level also varies. Thus, an elevator installation with unregulated power produces LED illumination magnitudes which vary to unacceptable levels.

Typical LED driver circuits used fixed resistors to limit and control the current flow through the LED. When the value of this current control resistor is calculated, one must account for the affects of the LED forward bias voltage drop. This forward bias voltage drop varies from LED to LED and from manufacturing lot to manufacturing lot. When the forward voltage drop varies, so does the current flowing through the LED which changes the light output level even though the applied voltage remains constant. Thus, two adjacent lighted push button switches can exhibit different illumination magnitudes.

SUMMARY OF THE INVENTION

The present invention concerns an apparatus for generating elevator call signals and indicating registered calls. The apparatus includes a plurality of manually actuated push button switch means, each of the switch means having a lighting means for lighting a push button of the switch means, an input means connected to the switch means for receiving a first predetermined duration illumination signal from a source of the illumination signal, and a pulse stretcher connected between the input means and the lighting means and being responsive to the illumination signal for generating an output signal for a second predetermined time period significantly longer than the first predetermined time period, the lighting means being responsive to the output signal for lighting the push button for approximately the second predetermined time period. The apparatus also includes a first plurality of row lines and a second plurality of column lines, and a control means connected to the input means of each of the switch means by one of the row lines and one of the column lines to form a matrix. The control means generating a scan signal on the one row line and receives a switch actuated signal in response thereto on the one column line when an associated one of the switch means is actuated. The control means generates the illumination signal on the one row line and the one column line to the input means connected to the one actuated switch in response to the switch actuated signal to maintain a lighted push button.

The control means generates the scan signal during a first cycle time, receives the switch actuated signal during a second cycle time and generates the illumination signal during a third cycle time. The control means generates the scan signal on the first plurality of row lines during the first cycle time and reads the second plurality of column lines during the second cycle time to receive the switch actuated signal wherein the control means alternately generates the scan signal and reads the column lines.

The control means is responsive to the actuated switch signal for generating the scan signal on a selected one of the first plurality of row lines during a fourth cycle time and reading the second plurality of column lines during a fifth cycle time to receive the switch actuated signal. The control means alternately generates the scan signal and reads the control lines for each of the row lines in sequence to identify the one actuated switch. The switch actuated signal can be generated with a first magnitude representing a call signal when access to a floor associated with the one actuated switch is permitted and the switch actuated signal is generated with a second magnitude representing a floor lock out signal when access to the floor associated with the one actuated switch is prohibited. The control means includes a first shift register connected to the column lines for receiving the call signal and a second shift register connected to the column lines for receiving the call signal and the floor lock out signal.

The control means includes a third shift register connected to the row lines for generating the scan signal and the illumination signal and a fourth shift register connected to the column lines for generating the illumination signal. The control means generates the illumination signal on the ones of the row lines and the column lines associated with each one of the switch means which has been actuated.

The apparatus according to the present invention solves the problems associated with the prior art illuminated call button circuits. The apparatus includes a unique pulse stretching circuit mounted on each switch that provides continuous current to the LED's maintaining the illumination quality achieved by non-scanned circuits.

The apparatus produces a voltage level shift on the matrix column lines to indicate when a security access switch has been activated. It does not require any additional wires between the control circuit and the switch matrix.

The LED current in the apparatus is controlled with a constant current regulation circuit that maintains a constant current for all applied voltages in a predetermined range. Illumination levels will not vary with the applied voltage.

The effects of LED forward bias voltage variations are eliminated because active current regulation replaces the fixed resistor found in most LED driver circuits. The regulator is like a variable resistor that automatically adjusts to maintain a constant LED current, and therefore a constant illumination level.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
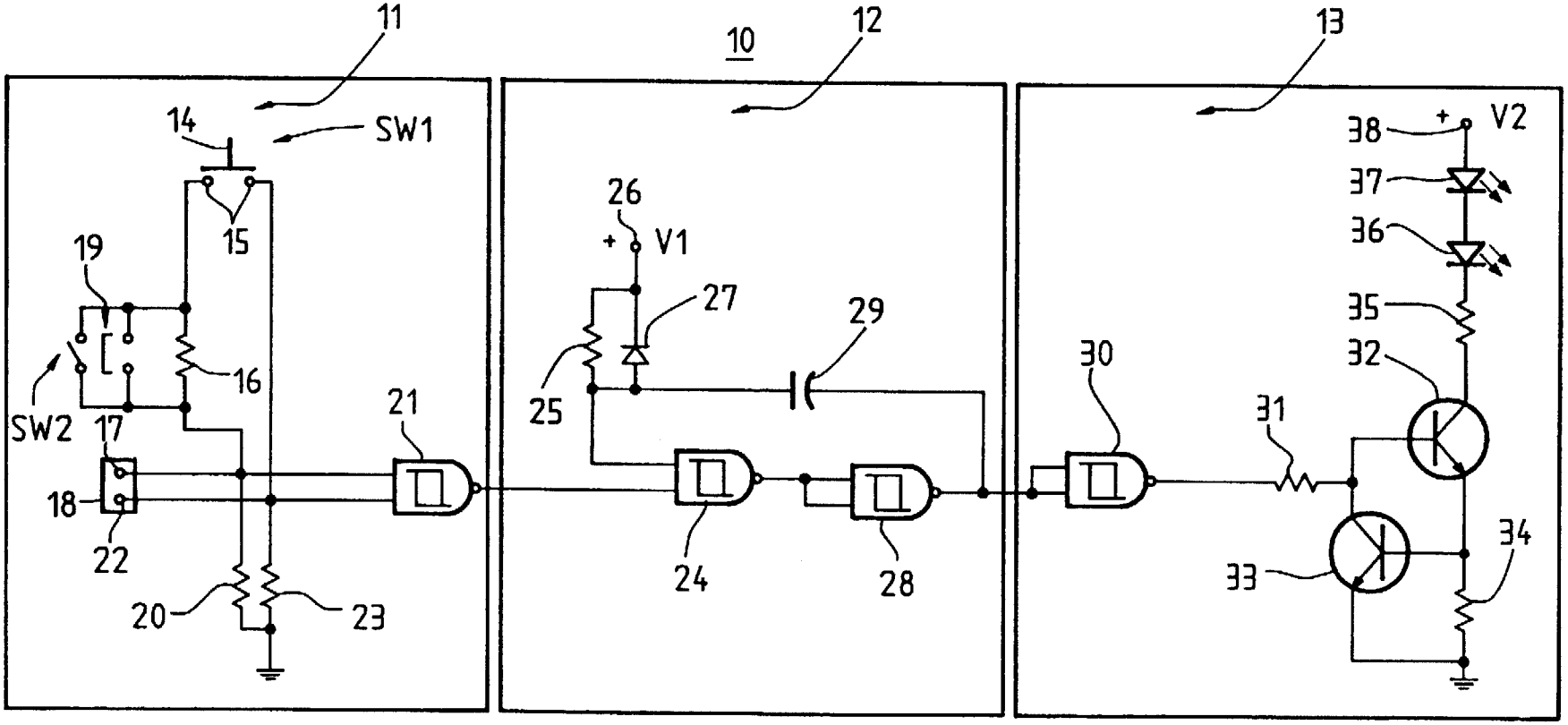
FIG. 1 is a schematic diagram of an elevator call button switch and illumination circuit in accordance with the present invention.

There is shown in the FIG. 1 an elevator call button switch and illumination circuit 10 in accordance with the present invention. The circuit 10 is modular and includes a switch module 11, a pulse stretcher module 12 and an illumination module 13. An individual one of the circuits 10 is associated with each call button of an elevator car operating controller. The switch module 11 includes a normally open, momentary contact, call button switch SW1 of the type typically installed in an elevator car control panel for registering calls to destination floors. A push button 14 of the switch SW1 is depressed to bridge a pair of switch contacts 15 to signal the car controller. As explained below, if the call is registered, the push button is illuminated until the call is served. A first one of the contacts 15 is connected through a first resistor 16 to a ROW terminal 17 of a terminal strip 18. Connected across the resistor 16 is a single pole access control switch SW2 for shunting the resistor. When the switch SW2 is not installed, a jumper 19 can be connected as a shunt across the resistor 16. As explained below, if the resistor 16 is not shunted, a call is not registered when the switch SW1 is actuated. The terminal 17 also is connected through a second resistor 20 to the circuit ground potential and to a first input of a first NAND gate 21. The other contact 15 of the switch SW1 is connected to a COLUMN terminal 22 of the terminal strip 18, to a second input of the NAND gate 21 and through a third resistor 23 to the circuit ground potential.

The NAND gate 21 has an output connected to a first input of a second NAND gate 24 in the pulse stretcher module 12. A second input of the NAND gate 24 is connected through a fourth resistor 25 to a positive potential terminal 26 of a first power supply V1. The output voltage of the power supply V1 typically is five volts. A first diode 27 is connected across the resistor 25 with an anode connected to the second input of the NAND gate 24 and a cathode connected to the power supply terminal 26. An output of the NAND gate 24 is connected to a pair of inputs of a third NAND gate 28. A capacitor 29 is connected between the second input of the NAND gate 24 and an output of the NAND gate 28.

The output of the NAND gate 28 is connected to a pair of inputs of a fourth NAND gate 30 in the illumination module 13. The NAND gate 30 has an output connected through a fifth resistor 31 to a base of a first NPN transistor 32 and to a collector of a second NPN transistor 33. The transistor 32 has an emitter connected through a sixth resistor 34 to the circuit ground potential and an emitter of the transistor 33 also is connected to the circuit ground potential. A collector of the transistor 32 is connected in series through a seventh resistor 35, a first LED (light emitting diode) 36 and a second LED 37 to a positive potential terminal 38 of a second power supply V2. Typically, the second power supply V2 has an output voltage of twenty-four volts. The terminal 38 is connected to an anode of the LED 37, a cathode of the LED 37 is connected to an anode of the LED 36 and a cathode of the LED 36 is connected to the resistor 35.

The terminals 17 and 22 of the switch module 11 are connected to a control circuit as explained below. Periodically, scan signals are applied to the ROW terminal 17 to check for actuation of the call button switch SW1 and, upon switch actuation, a switch actuation signal is generated at the COLUMN terminal 22 to the control circuit. When a call is registered, illumination signals are applied to the terminals 17 and 22 to illuminate the call button until the call is served. In operation, the inputs to the NAND gate 21 are at logic "0" such that a logic "1" is generated to the pulse stretcher module 12. Since both inputs to the NAND gate 24 are at logic "1", the NAND gate 28 generates a logic "1" to the illumination module 13. The NAND gate 30 generates a logic "0" which turns off the transistors 32 and 33 so that no current flows through the LED's 36 and 37 and the push button 14 is not lighted. A five volt positive potential scan signal is applied periodically to the ROW terminal 17 to test for closure of the call button switch SW1. If the switch SW1 is open, the scan signal will not appear at the COLUMN terminal 22 or the first input to the NAND gate 21. The NAND gate 21 will continue to generate a positive potential "1" logic output signal at the first input of the NAND gate 24 and there will be no changes in the pulse stretcher module 12 or the illumination module 13.

If switch SW1 is closed when the scan signal applied to the ROW terminal 17, a switch actuated signal will be generated at the COLUMN terminal 22 to indicate the closure of the push button 14 with the contacts 15. If switch SW2 is closed, or the jumper 19 is connected, when the switch SW1 is closed, the scan signal applied to the ROW terminal 17 will generate a positive potential five volt call signal as the switch actuated signal at the COLUMN terminal 22. Both inputs to the NAND gate 21 will be at logic "1" and the output will switch to generate a logic "0" signal at the first input of the NAND gate 24. The output of the NAND gate 24 will switch to logic "1" which causes the output of the NAND gate 28 to switch to logic "0". The NAND gate 30 responds by generating a logic "1" switching signal to turn on the transistors 32 and 33 and light the LED's 36 and 37. Since the voltage across the capacitor 29 cannot change instantaneously, the second input of the NAND gate 28 will change to the zero potential logic "0" level and charge toward the logic "1" level in accordance with the charging time constant defined by the values of the resistor 25 and the capacitor. During the charging time, the scan signal terminates and the first input to the NAND gate 24 returns to logic "1". When the second input to the NAND gate 24 reaches the logic "1" level after the charging delay, the outputs of the NAND gates 24, 28 and 30 switch logic levels to turn off the transistors 32 and 33.

If the resistor 16 is not shunted by either the switch SW2 or the jumper 19, as explained below, by proper selection of the value of the resistor 16, for example 4.32K ohms, the magnitude of the five volt scan signal at the ROW terminal 17 will be reduced at the COLUMN terminal 18 to generate, for example, a 0.8 volt floor lock out signal as the switch actuated signal which indicates that access to associated floor is limited and no call for that floor should be registered.

Figure 2:
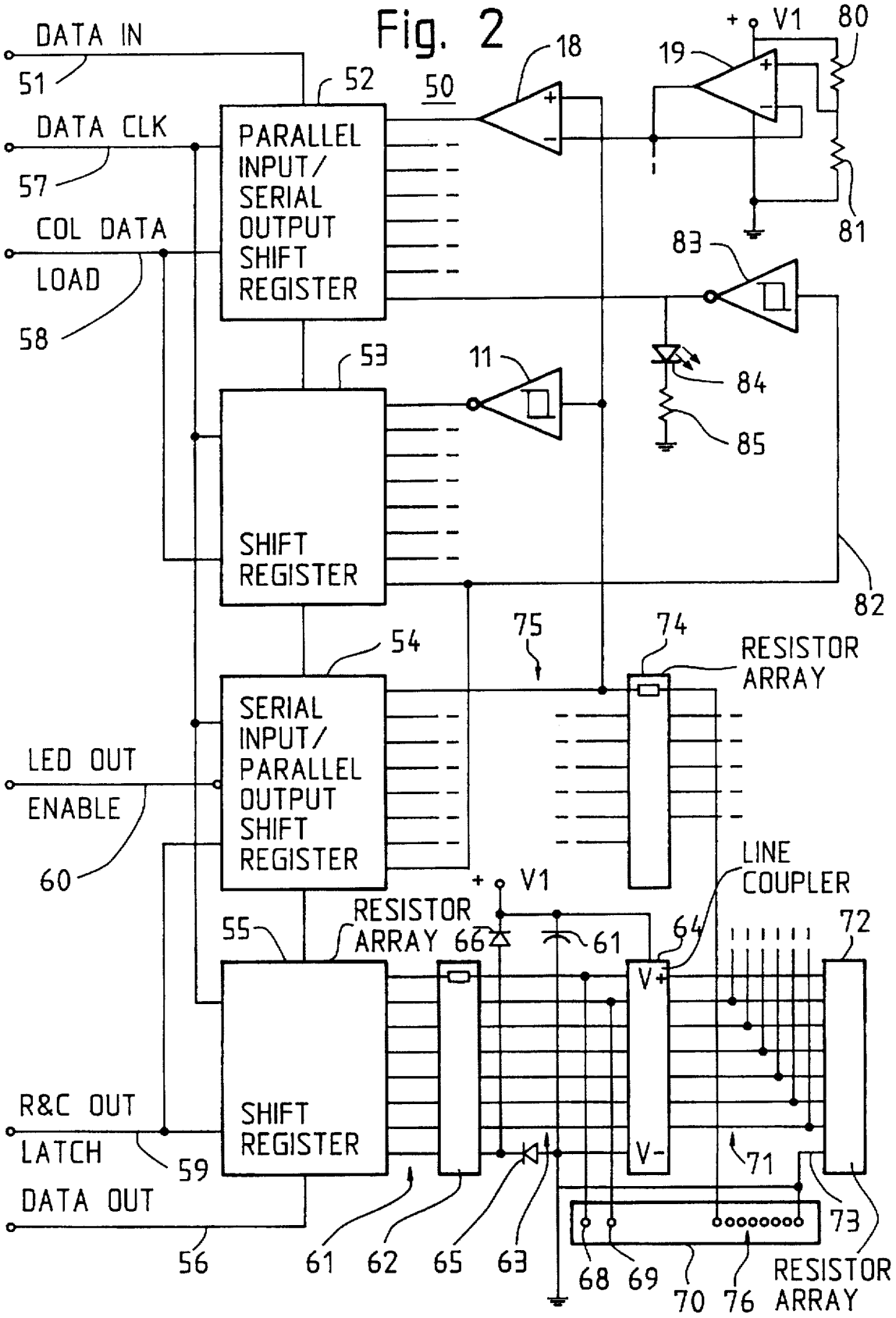
FIG. 2 is a schematic diagram of scanning and illumination control circuit in accordance with the present invention and used with the circuit shown in the FIG. 1.

There is shown in the FIG. 2 a scanning and illumination circuit 50 for generating the scan signals at the ROW terminal 17 of each of the elevator call button switch and illumination circuits 10 in an elevator car operating controller. The circuit 50 scans an eight row by seven column matrix wherein up to fifty-six of the switch circuits 10 each can connected to one of the rows and one of the columns. The circuit 50 can be connected in series with similar circuits to increase the number of circuits 10 which can be scanned. A data input line 51 (DATA IN) from a car operating controller (not shown) is connected to a serial data input of a first parallel input/serial output shift register 52 such as a 74HC165 shift register. As discussed below, a serial data stream of a plurality of cycles is generated by the controller on the line 51. A serial data output of the shift register 52 is connected to a serial data input of a second parallel input/serial output shift register 53. A serial data output of the shift register 53 is connected to a serial data input of a first serial input/parallel output shift register 54 such as a 74HC595 shift register. A serial data output of the shift register 54 is connected to a serial data input of a second serial input/parallel output shift register 55. A serial data output of the shift register 55 is connected to a data output line 56 which can be connected to a data input line of another circuit 50 or to the car operating controller.

A data clock line 57 (DATA CLK) from the elevator controller is connected to a clock input of each of the shift registers 52, 53, 54 and 55 to control the flow of the serial data stream through the circuit 50. A column data load line 58 (COL DATA LOAD) from the car operating controller is connected to a parallel data load input of each of the shift registers 52 and 53 to control latching of data at parallel inputs of these registers into the data stream. A row and column out latch line 59 (R&C OUT LATCH) from the car operating controller is connected to a parallel data latch input of each of the shift registers 54 and 55 to control latching of data in the data stream into the parallel outputs of these registers. An LED out enable line 60 (LED OUT ENABLE) is connected from the controller to an output enable input of the shift register 54 to selectively enable output of the latched signals from this register.

The shift register 55 has eight parallel output ports each connected by an associated one of eight row signal lines 61 to an associated input of a resistor array 62. Each input of the array 62 is connected to one end of a separate resistor having an opposite end connected to a separate output of the array. The outputs of the array 62 are connected by eight row signal lines 63 to associated inputs of a transient absorption circuit 64 such as a SP720AP circuit available from Harris Semiconductor. A diode 65 is connected in series with the bottom one of the lines 63 with an anode connected to a negative potential input of the transient absorption circuit 64 and a cathode connected to the array output. Another diode 66 has an anode connected to the cathode of the diode 65 and a cathode connected to the first power supply V1 which power supply also is connected to a positive potential input of the circuit 64. A capacitor 67 is connected between the anode of the diode 65 and the cathode of the diode 66. The anode of the diode 65 also is connected to the circuit ground potential. The resistor array 62, the circuit 64, the diode 65, the diode 66 and the capacitor 67 provide static discharge protection for the electronics in the circuit 50.

A pair of the row signal lines 63 are connected to associated ones of a pair of ROW terminals 68 and 69 of a terminal strip 70. Each of the terminals 68 and 69 can be connected to the ROW terminal 17 of an associated one of the elevator call button switch and illumination circuits 10 shown in the FIG. 1. The transient absorption circuit 64 has seven other inputs each connected by an associated one of seven column signal lines 71 with associated inputs of a resistor array 72. The resistor array 72 includes seven resistors each connected at one end to one of the lines 71 and connected at an opposite end to the circuit ground potential by a ground line 73. Each resistor in the array 72 has a value of approximately 820 ohms and cooperates with the unshunted resistor 16 in the circuit 10 to reduce the switch actuated signal magnitude on the column signal lines 71 to the approximately 0.8 volt floor lock out signal.

The column signal lines 71 also are connected to associated inputs of a resistor array 74 which has outputs connected by seven column signal lines 75 to seven associated parallel outputs of the shift register 54. The resistor array 74 also cooperates with the circuit 64 to provide static discharge protection for the electronics in the circuit 50. The column signal lines 71 are connected to associated ones of seven COLUMN terminals 76 of the terminal strip 70. Thus, signals present at the parallel outputs of the shift register 54 are generated through the column lines 75, the resistor array 74 and the column lines 71 to the COLUMN terminals 22 of associated ones of the circuits 10 connected to the COLUMN terminals 76. The terminal strip 70 is representative of four such strips required to connect to all of the eight row signal lines 63.

Each of the column signal lines 75 is also connected to an input of an associated inverter 77 and a non-inverting input of an associated comparator 78. The inverter 77 is representative of seven such inverters which can be 74HC14 Schmitt trigger inverters and the comparator 78 is representative of seven such comparators which can be LM324 comparator. An output of each inverter 77 is connected to one of seven parallel inputs of the shift register 53. The inverter 77 only generates an output signal in response to the five volt call signal. An output of each comparator 78 is connected to one of seven parallel inputs of the shift register 52. An amplifier 79 has a non-inverting input connected to the first power supply V1 through a resistor 80 and to the circuit ground potential through a resistor 81. An inverting input of the amplifier 79 is connected to an output which is connected to an inverting input of each of the comparators 78. The amplifier 79 generates an approximately 0.7 volt reference voltage level which causes the comparators to output a signal in response to both the five volt call signal and the 0.8 volt floor lock out signal. Thus, the shift register 52 receives switch actuated signals (call signals and floor lock out signals) representing actuated ones of the call button switches SW1 and the shift register 53 receives only call signals from actuated call button switches.

A line 82 connects an eighth parallel input of the shift register 53 and an eighth parallel output of the shift register 54 with an input of an inverter 83 which has an output connected to an eighth parallel input of the shift register 52. The output of the inverter 83 also is connected to an anode of an LED 84 which has a cathode connected through a resistor 85 to the circuit ground potential.

In operation, the elevator controller generates the data stream on the DATA IN line 51 and a clock signal on the DATA CLOCK line 57 to shift a scan cycle of scan signal data into the shift register 55. The scan signal data in the shift register 55 is latched at the parallel outputs by a signal generated by the controller on the R&C OUT LATCH line 59 while a signal on the LED OUT ENABLE line 60 prevents the shift register from outputting signals on the column lines 75. This scan signal data represents the row scan signals which are applied to all of the ROW terminals 17 of the circuits 10 through the row signal lines 61, the resistor array 62, the row signal lines 63 and the ROW terminals 68 and 69 of each of the four terminal strips 70. Any circuit 10 having an actuated call button switch SW1 will generate a call signal or a floor lock out signal at its COLUMN terminal 22 which is input to the circuit 50 at the associated one of the COLUMN terminals 76. A call signal is applied as a logic "0" to an associated parallel input of the shift register 53 through the column lines 71, the resistor array 74, the column lines 75 and the inverters 77. The absence of any call signal is applied as a logic "1". A call signal or a floor lock out signal is applied as a logic "1" to an associated parallel input of the shift register 52 through the column lines 71, the resistor array 74, the column lines 75 and the comparators 77. The absence of any switch actuated signal is applied as a logic "0". The controller clocks in a read cycle of the data stream, shifting out the scan cycle, and generates a signal on the COL DATA LOAD line 58 to insert the column data from the shift registers 52 and 53 into the read cycle of the data stream.

Figure 3:
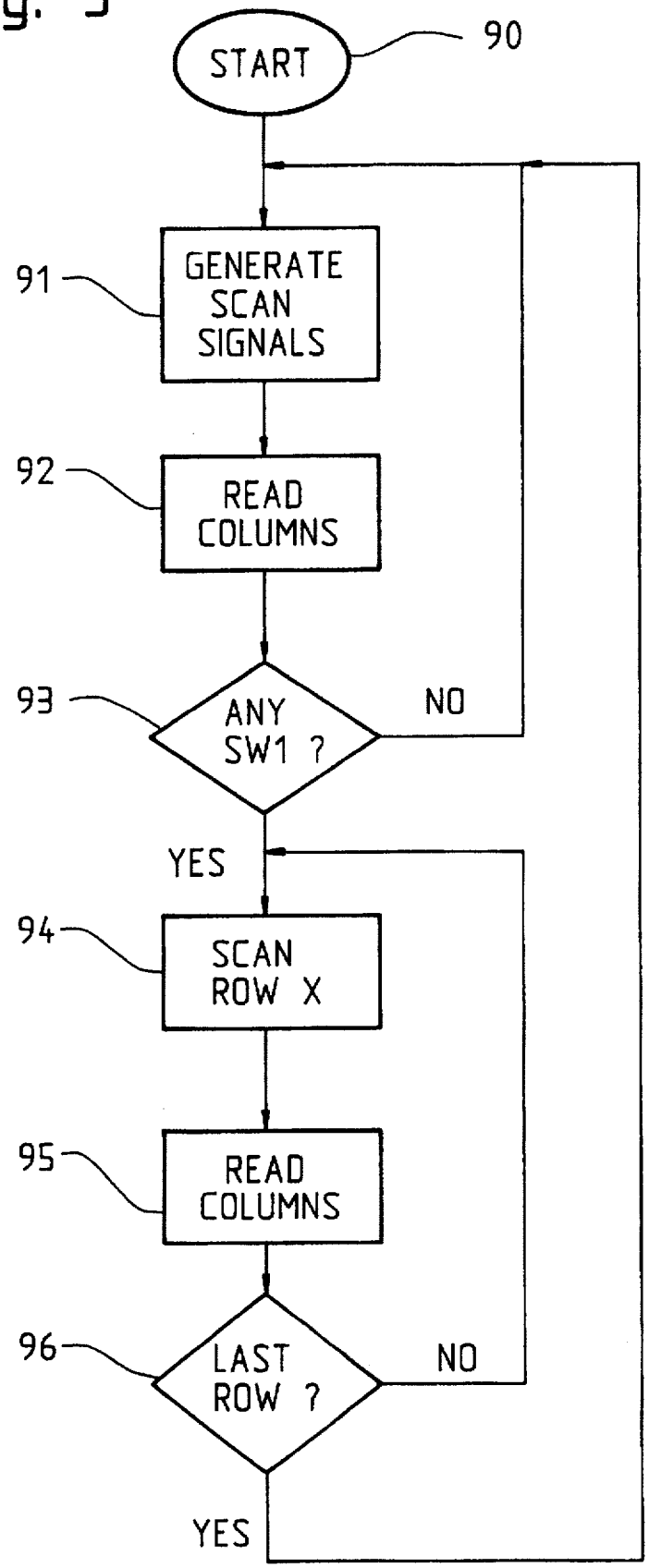
FIG. 3 is a flow diagram of the cycle sequence for the circuit shown in the FIG. 2.

A flow diagram of the program generating the data cycles for the circuit 50 is shown in the FIG. 3. The controller begins the cycles at a circle 90 START and the program enters an instruction set 91 GENERATE SCAN SIGNALS which initiates the scan cycle to generate the scan signals from the shift register 55 on all eight rows. The program enters an instruction set 92 READ COLUMNS which initiates the read cycle for the input of the signals at the inputs of the shift registers 52 and 53. The program enters a decision point 93 ANY SW1 ? wherein the controller checks for any actuated SW1 switches. If none of the switches SW1 are actuated, the program branches at NO back to the instruction set 91. The loop continues until at least one actuated switch is detected wherein the program branches at YES to an instruction set 94 SCAN ROW X to begin a second loop. In the instruction set 94, the controller initiates a scan cycle for the first row and then the program enters an instruction set 95 READ COLUMNS which initiates a read cycle to read the column data for the selected row. The program then enters a decision point 96 LAST ROW ? and branches at NO back to the instruction set 94 to initiate a scan cycle for the second row. Thus, the program saves time by executing the first loop until an actuated switch is detected and executing the second loop only when the actuated switch must be identified by its row and column connections. When the eighth row has been scanned, the program branches from the point 96 at YES to the instruction set 91 to restart the first loop.

Once a call has been registered, the controller generates an illumination cycle to light the LED's 36 and 37 of the associated circuit 10. Although the illumination cycle can be included in the first loop, it also can be an interrupt to the first loop. The interruption cycle generates illumination signals for the column and row corresponding to the registered call which signals are loaded into the shift registers 54 and 55 respectively. The controller generates signals on the LED OUT ENABLE line 60 and the R&C OUT LATCH line 59 to place a logic "1", illumination signal at each of the inputs of the NAND gate 21 in the associated circuit 10. The pulse stretcher module 12 extends the time that the LED's 36 and 37 are turned on to a multiple of the duration of the scan, read and illumination cycles, for example, approximately one second to maintain an acceptable level of illumination of the push button.

The eighth output of the shift register 54 can be utilized to indicate that an illumination cycle is being executed. A logic "0" signal will be changed to a logic "1" signal by the inverter 83 to light the LED 84 and provide a visual indication of the illumination cycle. The logic "0" at the eighth input of the shift register 53 and the logic "1" at the eighth input of the shift register 52 can be read to advise the controller that the illumination cycle was executed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for generating elevator call signals and indicating registered calls comprising:.

a manually actuated push button switch means for entering calls;

a means for lighting a push button of said switch means;

an input means for receiving a first predetermined duration illumination signal from a source of said illumination signal;

a resistor connected in series between said switch means and said input means whereby when a scan signal is applied to said input means and said switch means is actuated, a switch actuated signal is generated at said input means;

an access control switch means connected across said resistor whereby when said access control switch means is closed, said switch actuated signal has a first magnitude and when said access control switch means is open, said switch actuated signal has a second magnitude; and a pulse stretcher means connected between said means for lighting and said input means and being responsive to said illumination signal for generating an output signal for a second predetermined time period significantly longer than said first predetermined time period, said means for lighting being responsive to said output signal for lighting said push button for approximately said second predetermined time period.

2. The apparatus according to claim 1 wherein said first magnitude is approximately five volts and said second magnitude is approximately 0.8 volt.

3. The apparatus according to claim 1 wherein said means for lighting said push button includes at least one LED.

4. The apparatus according to claim 1 wherein said first predetermined time period is approximately a fraction of a second and said second predetermined time period is approximately one second.

5. An apparatus for generating elevator call signals and indicating registered calls comprising:

a switch means including a switch having a pair of contacts and a manually actuated push button for bridging said contacts, a lighting means for lighting said push button, an input means connected to said contacts for receiving a first predetermined duration illumination signal from a source of said illumination signal, and a pulse stretcher connected between said input means and said lighting means and being responsive to said illumination signal for generating an output signal for a second predetermined time period significantly longer than said first predetermined time period, said lighting means being responsive to said output signal for lighting said push button for approximately said second predetermined time period; and a control means connected to said input means of said switch means by a pair of lines, said control means generating a scan signal to one of said switch contacts and receiving a switch actuated signal from another of said switch contacts over said lines when said switch means is actuated, said control means generating said illumination signal to said input means over said lines in response to said switch actuated signal.

6. The apparatus according to claim 5 wherein said input means includes a first terminal connected to one of said contacts and a second terminal connected to another one of said contacts, said control means generating said scan signal at said first terminal and receiving said switch actuated signal at said second terminal.

7. The apparatus according to claim 6 wherein said control means generates said illumination signal at said first and second terminals.

8. The apparatus according to claim 5 wherein said control means generates said scan signal during a first cycle time, receives said switch actuated signal during a second cycle time and generates said illumination signal during a third cycle time.

9. The apparatus according to claim 8 wherein said second predetermined time period is significantly greater than each of said first, second and third cycle times.

10. An apparatus for generating elevator call signals and indicating registered calls comprising:

a plurality of manually actuated push button switch means, each said switch means having a lighting means for lighting a push button of said switch means, an input means connected to said switch means for receiving a first predetermined duration illumination signal from a source of said illumination signal, and a pulse stretcher connected between said input means and said lighting means and being responsive to said illumination signal for generating an output signal for a second predetermined time period significantly longer than said first predetermined time period, said lighting means being responsive to said output signal for lighting said push button for approximately said second predetermined time period;

a first plurality of row lines and a second plurality of column lines; and a control means connected to said input means of each of said switch means by one of said row lines and one of said column lines, said control means generating a scan signal on said one row line and receiving a switch actuated signal in response thereto on said one column line when an associated one of said switch means is actuated, said control means generating said illumination signal on said one row line and said one column line to said input means connected to said one actuated switch in response to said switch actuated signal.

11. The apparatus according to claim 10 wherein said control means generates said scan signal during a first cycle time, receives said switch actuated signal during a second cycle time and generates said illumination signal during a third cycle time.

12. The apparatus according to claim 11 wherein said control means generates said scan signal on said first plurality of row lines during said first cycle time and reads said second plurality of column lines during said second cycle time to receive said switch actuated signal, said control means alternately generating said scan signal and reading said column lines.

13. The apparatus according to claim 12 wherein said control means is responsive to said actuated switch signal for generating said scan signal on a selected one of said first plurality of row lines during a fourth cycle time and reading said second plurality of column lines during a fifth cycle time to receive said switch actuated signal, said control means alternately generating said scan signal and reading said control lines for each of said row lines in sequence to identify said one actuated switch.

14. The apparatus according to claim 12 wherein said switch actuated signal is generated with a first magnitude representing a call signal when access to a floor associated with said one actuated switch is permitted and said switch actuated signal is generated with a second magnitude representing a floor lock out signal when access to the floor associated with said one actuated switch is prohibited.

15. The apparatus according to claim 14 wherein said control means includes a first shift register connected to said column lines for receiving said call signal and a second shift register connected to said column lines for receiving said call signal and said floor lock out signal.

16. The apparatus according to claim 15 wherein said control means includes a third shift register connected to said row lines for generating said scan signal.

17. The apparatus according to claim 15 wherein said control means includes a third shift register connected to said row lines for generating said illumination signal and a fourth shift register connected to said column lines for generating said illumination signal, said control means generating said illumination signal on said ones of said row lines and said column lines associated with each one of said switch means which has been actuated.

* * * * *